US006087944A

United States Patent [19]

Santacatterina et al.

[11] Patent Number: 6,087,944

[45] Date of Patent: Jul. 11, 2000

[54] SYSTEM FOR INDICATING THE RESIDUAL HEAT OF THE PAN SUPPORT GRIDS OF DOMESTIC GAS COOKING APPLIANCES

[75] Inventors: Gianpiero Santacatterina, Sangiano; Luca Frasnetti, Cunardo; Giorgio Braghini, Varese, all of Italy

[73] Assignee: Whirlpool Corporation, Benton Harbor, Mich.

[21] Appl. No.: 09/197,356

[22] Filed: Nov. 20, 1998

[30] Foreign Application Priority Data

Nov. 21, 1997 [IT] Italy ..... MI97A0260

[51] Int. Cl.[7] ..... G08B 17/00

[52] U.S. Cl. ..... 340/588; 340/577; 340/578; 340/589; 219/445.1

[58] Field of Search ..... 340/584, 588, 340/589, 577, 578, 655; 219/445.1, 448.11, 448.17, 448.18, 512; 337/382, 383, 394

[56] References Cited

U.S. PATENT DOCUMENTS 4,044,348 8/1977 Huebscher ..... 340/588
4,388,520 6/1983 McWilliams ..... 219/445.1
4,544,831 10/1985 Bayer ..... 219/445.1
4,668,940 5/1987 Beard et al. ..... 340/521
4,990,750 2/1991 Martel et al. ..... 219/445.1

*Primary Examiner*—Daniel J. Wu
*Assistant Examiner*—Van T. Trieu
*Attorney, Agent, or Firm*—Joel M. Van Winkle; Robert O. Rice; Thomas J. Roth

[57] ABSTRACT

A system for indicating by means of at least one warning light the residual heat of at least one pan support grid for a gas burner in domestic cooking or heating appliances controlled by an electronic control device, in which the residual heat of the grid is measured indirectly by the electronic control device on the basis of data relative to the flame level set for the burner and the time for which said flame level is maintained, these data being corrected by a factor which takes account of the physical characteristics of the grid, such that the warning light is and remains activated when the residual heat of the grid exceeds a predetermined safety threshold (A) for its handling by the user.

4 Claims, 1 Drawing Sheet

SYSTEM FOR INDICATING THE RESIDUAL HEAT OF THE PAN SUPPORT GRIDS OF DOMESTIC GAS COOKING APPLIANCES

BACKGROUND OF THE INVENTION

1. Field of the Invention

This invention relates to a system for indicating to a user the residual heat of the pan support grids for gas burners of domestic cooking appliances, such as cookers, gas hobs and the like. The system of this invention is of the type defined in the introduction to the accompanying main claim.

2. Description of the Related Art

Above the gas burners of domestic appliances it is known to generally position a usually metal element in the form of a grid, the purpose of which is to support the pan and maintain it in its correct position, in particular while it is being heated. The grid can be constructed such as to extend over all or part of the burners, or alternatively each individual burner can have its own grid. The grids are removable to enable the user to clean the hob on which the burners are situated. During the use of the cooking appliance the grid or grids attain very high temperatures, and after the gas has been turned off require a considerable time, which can vary from a few to several minutes, to cool to a temperature level such as not to cause burns if touched. This cooling time depends on various factors including the mass of the grid or grids and the maximum temperature attained by them.

From the aforegoing considerations there is an apparent need for indicating to the user, for example visually, whether the grid or grids still have such a high residual temperature as to be able to cause burns if touched.

The residual grid temperature can be easily indicated by positioning a temperature sensor on the grid or in proximity thereto so as to measure its temperature, and connecting this sensor to a warning light which remains lit until the grid temperature attains a low level such as to be able to be handled without danger.

Solutions are known in the state of the art for measuring the residual temperature, in particular for glass ceramic hobs, either with electric heating elements or with gas burners positioned below the glass ceramic hob.

DE29619581 U1 relates to an invention which uses a solution analogous to the aforesaid applied to glass ceramic hobs, to measure the residual heat of the glass ceramic plate of a hob with external exposed gas burners.

Those solutions which use temperature sensors to measure the temperature of a hob or of the grids have however various drawbacks, including the difficulty of finding a position for the sensor such that it is not damaged, or in particular rendered inoperative, when the grid is removed and/or when the grid support surface is to be cleaned, and also the cost of a sensor which has to operate at high temperature.

The solution based on the use of sensors is hence inadequate.

SUMMARY OF THE INVENTION

An object of this invention is therefore to provide a system for indicating the residual heat of one or more pan support grids without using temperature sensors and hence free of the drawbacks of those systems which use them.

This and further objects which will be more apparent from the detailed description given hereinafter are attained by a system for indicating the residual heat of a pan support grid for gas burners in accordance with the content of the accompanying claims.

BRIEF DESCRIPTION OF THE DRAWINGS

The invention will be more apparent from the detailed description of a preferred embodiment thereof given hereinafter by way of non-limiting example with reference to the accompanying drawing, on which.

DESCRIPTION OF THE PREFERRED EMBODIMENT

Figure 1:
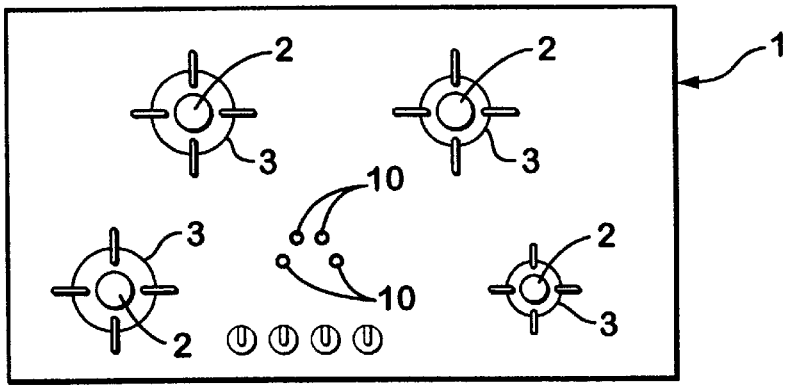
FIG. 1 is a schematic plan view of a cooking hob with four gas burners each provided with its own removable grid.
Figure 2:
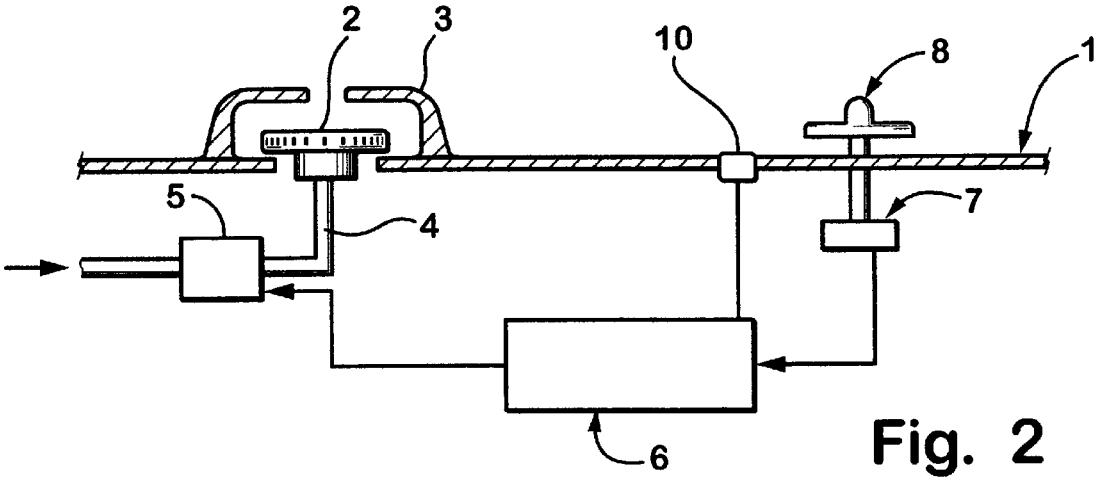
FIG. 2 is a schematic section through the hob, showing a burner, a warning light and a burner control knob.

In the figures the reference numeral 1 indicates a cooking hob comprising four gas burners 2, with each of which there is associated its own pan support grid 3, for example of metal, for supporting pans containing substances to be cooked or heated.

Each burner 2 is connected to any known gas source via a pipe 4 into which a solenoid valve 5 is connected to regulate the gas flow to the burner on the basis of signals reaching it from an electronic control device 6 (comprising a microprocessor), connected to a control member, for example a potentiometer of circular type or the like 7 operated by rotating a knob 8 to which it is operationally connected. On rotating the knob, the user varies (starting from zero, i.e. the burner inactivated) the voltage which the potentiometer 7 applies to the electronic control device 6, the output of which varies the operating conditions of the valve 5 and hence the gas flow to the burner 2. In other words, for each angular position, other than zero, which the user causes the knob 8 to assume, there corresponds a given gas throughput reaching the burner 2 via the valve 5, to which there corresponds a given flame level. The presence or absence of the flame is known to the device 6 by means of a traditional flame detector (not shown). In this manner the electronic control device knows exactly the flame levels set at the burner and is able to calculate the amount of time for which these levels have been maintained.

With these two items of data and adding a correction factor (to be determined experimentally and to be stored as data in the memory) which takes account of the physical characteristics of the particular pan support grid (material, mass, shape), the microprocessor incorporated into the electronic control device 6 is able to estimate what the residual temperature of the grid 3 will be even after the flame has been extinguished, and by means of a warning light 10, provided for example on the hob 1 and relative to the specific burner, provides the user with information concerning the grid temperature and hence its danger. If the warning light, for example a lamp, is active, the grid must not be touched without due caution by the user, who can however freely handle the grid when the warning light is extinguished.

Figure 3:
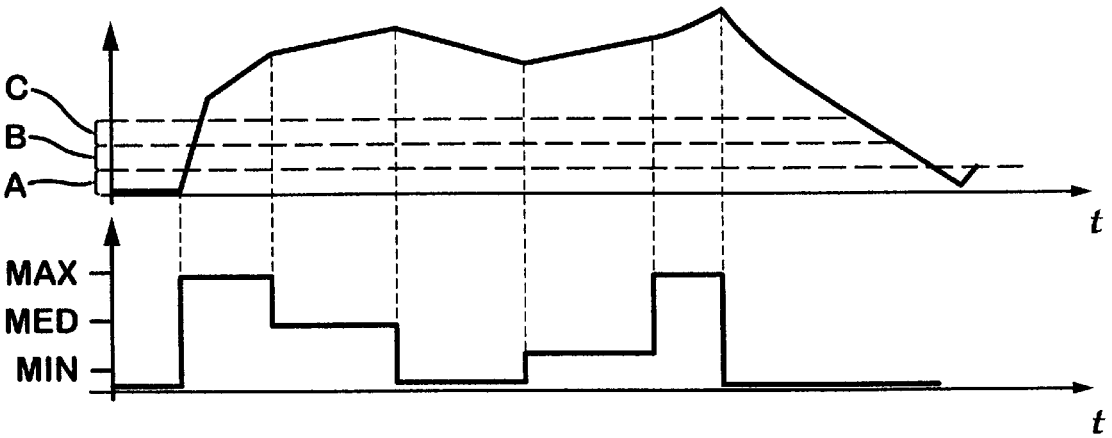
FIG. 3 shows two time diagrams, of which one, the upper one, relates to the estimated temperature of the grid of FIG. 2, and the other relates to the flame level of the burner associated with said grid.

The lower diagram of FIG. 3 shows by way of example the variation of the flame level with time, for which the upper diagram shows the variation of the estimated grid temperature. When the estimated grid temperature exceeds a predetermined safety value, indicated by A, the warning light is lit and is extinguished if equal to or less than that value. Alternatively, the warning light can comprise a plurality of operating thresholds indicating the danger level of the grid temperature (these thresholds are indicated by B, C, D in FIG. 3, by way of example). For example, a continuously active light indicates a very high grid temperature, an intermittently active light indicates intermediate temperatures, and an inactive light indicates a temperature which is not dangerous for the user. The number of thresholds providing intermittent light activation can be representative of the sensitivity of the user. For example, the intermittence can vary between a high frequency and a low frequency, so representing various grid temperatures. The user can then determine, on the basis of his own sensitivity, whether he can handle the grid at these temperatures (represented by the various activation frequencies).

The described embodiment has been provided by way of example, and is susceptible to numerous modifications.

Instead of the described rotary potentiometer, the following can be used as the selection device for the burner flame power: an encoder, a keypad by which different signals can be applied to the electronic control device via a key or a combination of keys operating on matrices for example of diode type, a sliding potentiometer, etc.

In addition, the warning light 10 can be a light emitting diode or a display in the form of light emitting segments. The solenoid valve 5 can be of modulating type. The electronic control device can have as many inputs as the number of burners, in order to be able to distinguish them and hence distinguish the relative grids.

In the case of a single grid common to all the burners, a single warning light is sufficient.

An embodiment of the invention has been described applied to a glass ceramic hob with external gas heating elements. However the invention can also be applied to hobs with heating elements positioned below the hob plate.

We claim:

1. A system for indicating by means of at least one warning light the residual heat of at least one pan support grid for a gas burner in domestic cooking or heating appliances without using a temperature sensor, the support grid having a plurality of physical characteristics including size and shape, the system comprising:

a valve connected to the gas burner for regulating the flow of gas to the gas burner;

a knob for manually inputting a selected flame level;

an angular position sensor associated with the knob for generating a flame level signal indicative of the angular position of the knob;

an electronic control device receiving the flame level signal and supplying a control signal to the gas valve for varying the operating conditions of the valve to operate the gas burner at the selected flame level, the electronic control valve measuring the time for which the gas burner is operated at the selected flame level, wherein the residual heat of the at least one pan support grid is measured indirectly by the electronic control device on the basis of data relative to the flame level signal for the burner and the time for which the selected flame level signal is maintained, these data being corrected by a factor which takes account of the physical characteristics of the grid, such that the warning light is and remains activated when the residual heat of the grid exceeds a predetermined safety threshold (A) for its handling by the user.

2. A system as claimed in claim 1, further wherein the electronic control device controls the warning light in response to a plurality of various activation thresholds.

3. A system as claimed in claim 2, further wherein the warning light operates intermittently with an intermittence depending on the temperature threshold attained by the heat of the grid.

4. A method for indicating the residual heat of at least one pan support grid for a gas burner in domestic cooking or heating appliances means of via at least one warning light, the support grid having a plurality of physical characteristics including size and shape, the method comprising the steps of:

selecting a desired flame level via a input device;

generating a flame level signal responsive to the input device;

supplying a control signal to a gas valve for varying the operating conditions of the gas valve to operate the gas burner at a selected flame level in accord with the flame level signal;

measuring the duration the gas valve is operated at the selected flame level;

calculating the residual heat of the at least one pan support grid on the basis of data relative to the flame level signal for the burner and the time for which the selected flame level is maintained, these data being corrected by a factor which takes account of the physical characteristics of the grid, such that the warning light is and remains activated when the residual heat of the grid exceeds a predetermined safety threshold (A) for its handling by the user.

* * * * *